United States Patent [19]

Miyamoto et al.

[11] Patent Number: 4,565,778

[45] Date of Patent: Jan. 21, 1986

[54] SILVER HALIDE PHOTOGRAPHIC MATERIALS

[75] Inventors: Akihiko Miyamoto; Hideki Takiguchi; Shoji Matsuzaka; Hiroshi Kashiwagi; Yoshiyuki Nonaka, all of Hino, Japan

[73] Assignee: Konishiroku Photo Industry Co., Ltd., Tokyo, Japan

[21] Appl. No.: 593,635

[22] Filed: Mar. 26, 1984

[30] Foreign Application Priority Data

Mar. 31, 1983 [JP] Japan ..... 58-57649
Apr. 7, 1983 [JP] Japan ..... 58-61874
Apr. 15, 1983 [JP] Japan ..... 58-67181

[51] Int. Cl.[4] ..... G03C 1/28; G03C 1/34

[52] U.S. Cl. ..... 430/567; 430/569; 430/603; 430/605; 430/566; 430/564; 430/613; 430/615

[58] Field of Search ..... 430/567, 569, 603, 566, 430/564, 599, 613, 615, 605

[56] References Cited

U.S. PATENT DOCUMENTS 3,408,197 10/1968 McVeigh ..... 430/603
3,420,667 1/1969 Copeland ..... 430/599
3,574,628 4/1971 Jones ..... 430/567
3,689,273 9/1972 Willems et al. ..... 430/603
4,221,863 9/1980 Overman et al. ..... 430/567
4,377,634 3/1983 Mitune et al. ..... 430/603
4,401,754 8/1983 Suzuki et al. ..... 430/603
4,444,877 4/1984 Koitabashi et al. ..... 430/567

*Primary Examiner*—Won H. Louie
*Attorney, Agent, or Firm*—Frishauf, Holtz, Goodman & Woodward

[57] ABSTRACT

Silver halide photographic materials with higher sensitivity and less fogging having at least one silver halide emulsion layer over a photographic base or support wherein the emulsion of said emulsion layer substantially contains core/shell-type silver halide grains or core/shell-type monodisperse silver halide grains, core portion of said grain containing silver iodide in a greater amount than that contained in shell portion of said grain and said emulsion is subjected to chemical ripening in the presence of a labile selenium compound, optionally with coexistence of a silver halide solvent, and said emulsion may contain further a specific phenol compound.

28 Claims, No Drawings

SILVER HALIDE PHOTOGRAPHIC MATERIALS

BACKGROUND OF THE INVENTION

This invention relates to a silver halide photographic material and, more particularly, it is concerned with a silver halide photographic material sensitized by chemical ripening of a silver halide emulsion containing silver halide grains mainly composed of silver iodobromide.

As photographic silver halide, there have been previously put to practical use a wide variety of silver halides such as silver chloride, silver bromide, silver chlorobromide, silver iodobromide, silver chloroiodobromide and the like; particularly, silver iodobromide has been employed as a silver halide for a highly sensitive photograph to prepare a highly sensitive emulsion.

Recently, a demand has become more severe for a silver halide emulsion for a highly sensitive photograph and a increasingly higher level of demand has been placed for photographic performances such as higher sensitivity, superior graininess, higher sharpness, lower fogging density, sufficiently higher optical density and the like. On the other hand, a strong demand for development of a lower silver content photosensitive material has occured in view of indication of a recent exhaustion of silver resourse. These seemingly different demands could be probably met by technique for preparing a silver halide emulsion with low fogging and high sensitivity. Therefore, it may be said that development of a silver iodobromide-type silver halide emulsion with lower fogging and higher sensitivity is the most important subject in this field.

In order to increase sensitivity of a silver halide photographic emulsion, there have been proposed various chemical sensitization methods wherein chemical ripening is carried out in the presence of a variety of chemical substances; typically, there is known chemical ripening using sulfur sensitization, selenium sensitization, noble metal sensitization, reduction sensitization or any combination thereof.

Of the above sensitization methods, selenium sensitization is disclosed, for example, in U.S. Pat. Nos. 1,574,944, 1,623,499, 1,602,592, 2,642,361, 2,739,060, 3,297,446, 3,420,670, 3,320,069, 3,658,540, 3,408,196, 3,408,197, 3,442,653, 3,591,385; British Pat. Nos. 255,846, 861,984; West German Pat. Nos. 10 33 510, 15 47 762; French Pat. Nos. 2,093,038, 2,093,209; Japanese Patent Publication Nos. 34491/1977, 34492/1977, 295/1978, 36009/1977, 38409/1977, 22090/1982. However, selenium sensitization could generally provide a greater sensitization effect as compared with sulfur sensitization commonly practised in the art at the present time, but the former sensitization has drawbacks in easily producing fogging and also soft gradation; hence it is said to be difficult in practical use. On the other hand, a method wherein silver iodide incorporated into silver bromide or silver chlorobromide up to such a range to form a solid solution or some mixed crystals, has been proposed for increasing sensitivity inherent in silver halide grain itself. For instance, A. P. H. Tripeli and W. F. Smith reported in Photographic Journal, 79, 463 (1939) that, where silver iodide is incorporated into silver bromide, a sensitivity could be increased as its silver iodide content is increased up to a certain content.

However, silver halide grains having silver iodide incorporated therein have a drawback of showing soft gradation as its silver iodide content is increased.

As explained above, both selenium sensitization and application of silver iodide for increase in sensitivity, which could be expected as promising measures for higher sensitization, could not adequately control other important photographic property, i.e., gamma ($\gamma$) to provide soft gradation. This has led to closure against utilization of both measures, thus disturbing the development of a photographic material.

SUMMARY OF THE INVENTION

It is, accordingly, a primary object of this invention to provide a silver halide photosensitive material with high sensitivity, proper gamma and less fogging.

Other objects of this invention will become apparent from the following description.

As a result of our studies, it has been found that a higher silver iodide distribution in the core portion of a silver halide grain and a lower silver iodide distribution in the shell portion of said grain are preferable for higher sensitivity and proper gamma and this can be, therefore, embodied preferably with core/shell-type silver halide grains, and also that the emulsion containing core/shell-type grains having the above-mentioned silver iodide distribution can be sensitized with non-soft gradation or high contrast by chemical ripening in the presense of a selenium compound, especially a "labile" selenium compound, said chemical ripening being effectively accelerated in the further presence of a silver halide solvent.

It has been also found that the coexistence of a specific phenol derivative is effective in prevention of soft gradation or for production of high contrast when it is added to an emulsion after a desalting step, if involved in course of preparation or preferably after a physical ripening step, if said desalting step not involved in course of preparation. This silver halide emulsion according to this invention may preferably be prepared by a process in which a desalting step is involved.

This invention has been completed upon the above-mentioned findings and this invention is directed to a silver halide photographic material having at least one silver halide emulsion layer over a base or support, characterized in that an emulsion in said emulsion layer substantially contains core/shell-type silver halide grains or core/shell-type monodisperse silver halide grains, a core portion of said grain containing silver iodide in a greater amount than an amount contained in a shell portion of said grain, and said emulsion is subjected to chemical ripening in the presence of a labile selenium compound.

DESCRIPTION OF THE PREFERRED EMBODIMENTS

This invention will be more concretely illustrated herein below.

The core/shell-type silver halide grain in this invention is composed of at least one layer of respective core shell portions having respectively different silver iodide contents and the silver iodide content in said shell portion is adjusted to be lower than that in said core portion. The lower the silver iodide content in said shell is, the more preferable it is. The content close to approximately 0% is still more preferable. Thus, silver bromide is substantially preferable for the shell portion.

Moreover, the core portion of said grain may be formed in two or more layers having different silver iodide contents. Difference in silver iodide content of said silver halide grain may be critically sharp between a higher content layer and a lower content one, or it may be continuously variable without any positively sharp boundary.

Said silver iodide distribution in silver halide grain may be detected by various physical measurements, for instance, by determination of luminescence at a lower temperature as disclosed in a summary text for the Annual meeting of the Japanese Photography Society for the 56th year of Showa.

In the present core/shell-type silver halide grain, a thickness of said shell portion may vary with regard to the most suitable thickness depending upon a diameter of said core portion, but silver halide grain with a shell portion thickness of 0.01 to 0.3 μm is preferable.

In an embodiment of preferable silver halide grain according to this invention, silver halide formulation in said core portion is silver halide containing 1 to 15 molar % of silver iodide and silver halide formulation in said shell portion is silver halide containing 0 to 4 molar % of silver iodide. It is also preferable that a difference in silver iodide content between said shell portion and said core portion is not less than 1 molar %. In the present silver halide grain, other silver halide formulation than said silver iodide may be preferably and mainly silver bromide, but silver chloride may be also contained unless effects of this invention would be adversely affected.

The total silver iodide content in the present silver halide grain is preferably of 0.5 molar % to 15 molar %.

While the present silver halide grain may be of any shape, e.g., hexadedron, octahedron, tetradecahedron, plate or sphere or a mixture thereof, octahedral or tetradecahedral grain is preferable.

The silver halide grain which may be employed for the silver halide emulsion in this invention may preferably contain said core/shell-type silver halide grain at 70% or more upon all grains in a single silver halide emulsion layer, all grains being most preferably core/-shell-type silver halide grains.

The core/shell-type silver halide grains in this invention may be employed alone or in optional admixture with two or more sorts of silver halide grains having different grain diameters. Also, a mixture of two or more silver halide grains having different silver iodide contents may be preferably employed as illustrated below.

Said core/shell-type emulsion may be prepared by first preparing a mother emulsion having a prescribed silver iodide content and forming a core portion and then forming a shell portion by precipitating said silver halide at such a precipitation rate that no silver halide grains in said mother emulsion can be dissolved away and a surface of said grain may serve the surface for depositing thereover siliver halide crystals newly precipitated. Formation of said shell portion may be influenced upon conditions of the mother emulsion, but formation conditions may be experimentally determined.

In one embodiment of this invention, core/shell-type monodisperse silver halide grains, monodispersability of said grains is such that a distribution defined by the following equation may be 20% or lower, preferably not more than 15%:

$$\frac{\text{Standard deviation}}{\text{Average grain diameter}} \times 100 = \text{Width of distribution (\%)}$$

The present emulsion containing said monodisperse silver halide grains may be prepared by first preparing a mother emulsion containing the monodisperse silver halide grains to form a core portion and then coating a shell portion over said grains.

For making a core portion to a monodisperse silver halide grain, a double jet method with Ag being kept constant may provide grains with a desired grain size. Also, a highly monodisperse silver halide emulsion may be formed by application of the method disclosed in Japanese Patent Laid-Open Application No. 48521/1979. In a preferred embodiment of that method, an aqueous solution of potassium iodobromide-gelatin and an aqueous solution of ammoniac silver nitrate may be added to an aqueous solution of gelatin containing silver halide seed grains at a variable addition rate as a function of time. In this instance, a highly monodisperse silver halide emulsion may be produced by optional selection of a function of addition rate to time, pH, pAg, temperature and others. The so-obtained highly monodisperse silver halide emulsion may be used for preparing the desired core/shell-type monodisperse silver halide emulsion according to the same procedures as set forth above.

As the selenium compound which may be employed in this invention and is frequently referred to as a selenium sensitizer, a labile selenium compound is preferably selected from those selenium compounds as disclosed in the above-recited Patents or Published or Laid-Open Patent Applications.

The term "labile" as used herein for the selenium compound is well-known to those skilled in the art and, in this case, intended to mean a substance capable of forming a silver salt in situ when added to an aqueous solution of silver nitrate; for instance, a labile sulfur compound may produce silver sulfide, while a labile selenium compound may produce silver selenide.

The selenium sensitizer, which may be employed in this invention, may include a wide variety of labile selenium compounds, for example, those as disclosed, e.g., U.S. Pat. Nos. 1,623,499, 1,574,944 and 1,602,592. Useful selenium sensitizers may contain a colloidal selenium metal, an aliphatic isoselenocyanate, e.g., allyl isoselenocyanate and the like. A particularly useful class of selenium sensitizers may contain an aliphatic selenourea wherein the aliphatic portion may be, for example methyl, ethyl, propyl, isopropyl, butyl or the like; a selenoketone, for example, selenoacetone, selenoacetophenone and the like; a selenoamide; a selenocarboxylic acid and the like. Other useful selenium sensitizers may include analogous selenourea containing one or more aromatic groups, e.g., phenyl or tolyl or heterocyclic groups, e.g., benzothiazolyl or pyridyl.

In addition to the above-mentioned labile organic selenium compounds, there may be also employed other useful selenium sensitizers which contain a labile selenium atom: These sensitizers may include, for example, tetramethylselenourea, N-(β-carboxyethyl)N',N'-dimethylselenourea, selenoacetamide, diethylselenide, 2-selenopropionic acid, 3-selenobutyric acid, methyl 3-selenobutyrate, tri-p-tolylselenophosphate and the like.

The amount of the selenium sensitizer to be used may vary depending upon a particular selenium compound to be applied, a silver halide property, ripening condition and others. The selenium sensitizer may be generally used in the range of about $1.0\times10^{-4}$ to 5 mg, preferably about 0.001 to 5 mg per one mole of silver halide.

Ripening in selenium sensitization may be usually effected at 30° C. to 70° C. for 0.5 hour to 3 hours.

In this invention, known types of sulphur sensitizers can be used. Their examples include thiosulfate, allylthiocarbamidothiourea, allylisothiocyanate, cystine, p-toluenethiosulfonate and rhodanine. Besides, there can be employed sulphur sensitizers which are disclosed in U.S. Pat. Nos. 1,574,944, 2,410,689, 2,278,947, 2,728,668, 3,501,313 and 3,656,955, German Pat. No. 1,422,869, and Japanese Patent Provisional Publication Nos. 24937/1981 and 45016/1980. The amount of the sulphur sensitizer is such that it effectively increases the sensitivity of the emulsion. This amount varies over a fairly extensive range under various conditions such as the amount of the used nitrogen-containing heterocyclic compound, a pH, a temperature and the size of the silver halide grains, but 0.5 mg to 2.0 mg per mol of the silver halide is preferable, as a standard, and 0.7 mg to 1.5 mg is most preferable.

In the nitrogen-containing heterocyclic compounds used in this invention, examples of nitrogen-containing heterocyclic rings include a pyrazole ring, pyrimidine ring, 1,2,4-triazole ring, 1,2,3-triazole ring, 1,3,4-thiadiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, 1,2,4-triazine ring, 1,3,5-triazine ring, benzotriazole ring, benzimidazole ring, benzothiazole ring, quinoline ring, benzoxazole ring, benzoselenazole ring, naphthothiazole ring, naphthoimidazole ring, rhodanine ring, thiohydantoin ring, oxazole ring, thiazole ring, oxadiazole ring, selenadiazole ring, naphthoxazole ring, oxazolidinedione ring, triazolotriazole ring, azaindene ring (e.g., diazaindene ring, triazaindene ring, tetrazaindene ring and pentazaindene ring), phthalazine ring and indazole ring.

Preferred nitrogen-containing heterocyclic compounds have the azaindene rings among the above rings, and azaindene compounds having hydroxy groups as substituent groups, e.g. hydroxytriazaindene, tetrahydroxyazaindene and hydroxypentazaindene compounds are more preferable.

The heteroyclic rings may have substituent groups other than the hydroxy group. Examples of the other substituent groups include an alkyl group, alkylthio group, amino group, hydroxyamino group, alkylamino group, dialkylamino group, arylamino group, carboxy group, alkoxycarbonyl group, halogen atom, acylamino group, cyano group and mercapto group.

Examples of the nitrogen-containing compounds used in this invention are as follows, but they are not to be limited to the examples below:

N-1 2,4-Dihydroxy-6-methyl-1,3a,7-triazaindene
N-2 2,5-Dimethyl-7-hydroxy-1,4,7a-triazaindene
N-3 5-Amino-7-hydroxy-2-methyl-1,4,7a-triazaindene
N-4 4-Hydroxy-6-methyl-1,3,3a,7-tetrazaindene
N-5 4-Hydroxy-1,3,3a,7-tetrazaindene
N-6 4-Hydroxy-6-phenyl-1,3,3a,7-tetrazaindene
N-7 4-Methyl-6-hydroxy-1,3,3a,7-tetrazaindene
N-8 2,6-Dimethyl-4-hydroxy-1,3,3a,7-tetrazaindene
N-9 4-Hydroxy-5-ethyl-6-methyl-1,3,3a,7-tetrazaindene
N-10 2,6-Dimethyl-4-hydroxy-5-ethyl-1,3,3a,7-tetrazaindene
N-11 4-Hydroxy-5,6-dimethyl-1,3,3a,7-tetrazaindene
N-12 2,5,6-Trimethyl-4-hydroxy-1,3,3a,7-tetrazaindene
N-13 2-Methyl-4-hydroxy-6-phenyl-1,3,3a,7-tetrazaindene
N-14 4-Hydroxy-6-methyl-1,2,3a,7-tetrazaindene
N-15 4-Hydroxy-6-ethyl-1,2,3a,7-tetrazaindene
N-16 4-Hydroxy-6-phenyl-1,2,3a,7-tetrazaindene
N-17 4-Hydroxy-1,2,3a,7-tetrazaindene
N-18 4-Methyl-6-hydroxy-1,2,3a,7-tetrazaindene
N-19 7-Hydroxy-5-methyl-1,2,3,4,6-pentazaindene
N-20 5-Hydroxy-7-methyl-1,2,3,4,6-pentazaindene
N-21 5,7-Dihydroxy-1,2,3,4,6-pentazaindene
N-22 7-Hydroxy-5-methyl-2-phenyl-1,2,3,4,6-pentazaindene
N-23 5-Dimethylamino-7-hydroxy-2-phenyl-1,2,3,4,6-pentazaindene
N-24 1-Phenyl-5-mercapto-1,2,3,4-tetrazole
N-25 6-Aminopurine
N-26 Benzotriazole
N-27 6-Nitrobenzimidazole
N-28 3-Ethyl-2-methylbenzothiazoliump-toluenesulfonate
N-29 1-Methylquinoline
N-30 Benzothiazole
N-31 Benzoxazole
N-32 Benzoselenazole
N-23 Benzimidazole
N-34 Naphthothiazole
N-35 Naphthoselenazole
N-36 Naphthoimidazole
N-37 Rhodanine
N-38 2-Thiohydantoin
N-39 2-Thio-2,4-oxazolidinedione
N-40 3-Benzyl-2-mercaptobenzimidazole
N-41 2-Mercapto-1-methylbenzothiazole
N-42 5-(m-Nitrophenyl)tetrazole
N-43 2,4-Dimethylthiazole
N-44 1-Methyl-5-ethoxybenzothiazole
N-45 2-Methyl-β-naphthothiazole
N-46 1-Ethyl-5-mercaptotetrazole
N-47 5-Methylbenzotriazole
N-48 5-Phenyltetrazole
N-49 1-Methyl-2-mercapto-5-benzoylamino-1,3,5-triazole
N-50 1-Benzoyl-2-mercapto-5-acetylamino-1,3,5-triazole
N-51 2-Mercapto-3-aryl-4-methyl-6-hydroxypyrimidine
N-52 2,4-Dimethyloxazole
N-53 1-Methyl-5-phenoxybenzoxazole
N-54 2-Ethyl-β-naphthoxazole
N-55 2-Mercapto-5-aminothiadiazole
N-56 2-Mercapto-5-aminoxazole
N-57 2-Mercapto-5-aminoselenadiazole An amount of the nitrogen-containing heterocyclic compound to be added varies extensively in compliance with the size of the silver halide grains, composition, ripening condition and the like, but the compound is required to be added in such an amount as to enable the formation of from a single molecular layer to 10 molecular layers on the surface of each silver halide grain. This amount can be adjusted by the control of an adsorption equilibrium condition in accordance with a variation of a pH and/or temperature at the time of ripening.

The nitrogen-containing heterocyclic compound can be used together with a sensitizing dye at the time of the selenium-sulphur sensitization of this invention. In this case, the nitrogen-containing heterocyclic compound and the sensitizing dye are added in such a total amount as to enable the formation of from the single molecular layer to 10 molecular layers on the surface of each silver halide grain, but it is preferred that the amount of the sensitizing dye does not exceed 70% of an amount to permit forming the single molecular layer on the surface of the silver halide grain.

The amount of the nitrogen-containing heterocyclic compound necessary for the formation of the single molecular layer can be determined by a drawn adsorption isotherm, but, for example, when the silver iodobromide emulsion grains comprising octahedral grains of 0.65 um in diameter are covered with 4-hydroxy-6-methyl-1,3,3a,7-tetrazaindene, its necessary amount is approximately 210 mg/Ag mol. Therefore, an area occupied by this compound is approximately 30 $Å^2$ per molecule. For other grains different in diameter, the amount of the compound may be found by an area proportion calculation, taking the value of the above example as a standard.

The nitrogen-containing heterocyclic compounds used in this invention are preferably colorless.

The addition of the nitrogen-containing heterocyclic compound into the emulsion can be carried out in the form of a solution where it is dissolved in a suitable solvent (e.g., water or an aqueous alkaline solution) which has no harmful influence on the photographic emulsion. The compound above may exist in the emulsion at the time of the selenium-sulphur sensitization, and it is preferred that the compound is added thereto at the time of or before the addition of a sulphur sensitizer or selenium sensitizer.

The present emulsion can be additionally and concurrently subjected to gold sensitization to accomplish a much greater sensitization together with inhibition of increase in fogging to the minium range. The amount of a gold sensitizer to be applied in this invention is preferably in the range of about $10^{-7}$ mole to $10^{-1}$ mole per mole of a silver halide. As the gold sensitizer which may be used for the present chemical ripening, there may be applied a variety of gold compounds having any oxidation number of gold of either +1 or +3. Representative examples thereof may include, for example, chloroaurate, potassium chloroaurate, auric trichloride, potassium auric thiocyanate, potassium iodoaurate, tetracyanoauric acid, ammonium aurothiocyanate, pyridyltrichlorogold and the like.

In this invention there may be additionally employed reduction sensitization. There is no particular limitation to the reducing agent to be used and there may be mentioned, for example, well-known stannous chloride, thiourea dioxide, hydrazine derivatives, silane compounds and the like. Reduction sensitization may be preferably conducted during growth of silver halide grains or after completion of selenium sensitization and gold sensitization.

Further, a remarkably higher sensitization in the present silver halide grains can be also accomplished by conducting chemical ripening in the presence of a silver halide solvent. As the silver halide solvent which may be employed in this invention, there may be mentioned, for example, (a) organic thioethers, e.g., those as disclosed in U.S. Pat. Nos. 3,271,157, 3,531,289 and 3,574,628 and Japanese Laid-Open Patent Application Nos. 1019/1979 and 158917/1979 and the like; (b) thiourea derivatives, e.g., those as disclosed in Japanese Laid-Open Patent Application Nos. 82408/1978, 77737/1980, 2982/1980 and the like; (c) silver halide solvents having a thiocarbonyl group between an oxygen or sulfur atom and a nitrogen atom, e.g., those as disclosed in Japanese Laid-Open Patent Application No. 144319/1978; (d) imidazoles, e.g., those as disclosed in Japanese Laid-Open Patent Application No. 100717/1979; (e) sulfites; (f) thiocyanates silver halide solvents as disclosed in Japanese Laid-Open Patent Application No. 196228/1982; and others. Illustrative compounds thereof are recited below.

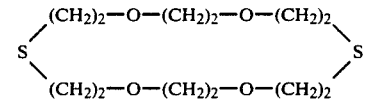
(Z - 1)

$HO-(CH_2)_2-S-(CH_2)_2-S-(CH_2)_2-OH$ (Z - 2)

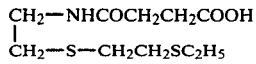
(Z - 3)

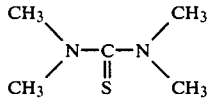
(Z - 4)

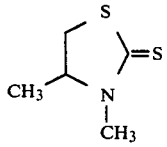
(Z - 5)

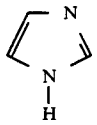
(Z - 6)

$K_2SO_3$ (Z - 7)
$NH_4SCN$ (Z - 8)
KSCN (Z - 9)

Particularly preferable solvents may include thiocyanate and tetramethylthiourea. The amount of the solvent to be used may vary depending upon the sort of the solvent used: For instance, where thiocyanate is to be applied, a preferable amount thereof is in the range of 5 mg to 5 g per mole of a silver halide.

In the present core/shell-type silver halide grain emulsion which may be monodispersed, there may be further incorporated at least one of the phenol derivative having the following formula (I) for improving gamma (γ).

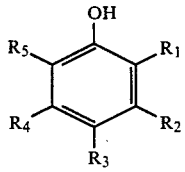
(I)

wherein $R_1$, $R_2$, $R_3$, $R_4$ and $R_5$ individually represent a hydrogen atom, a halogen atom, a hydroxy group, an alkoxy group, an amino group, an acylamino group, an acyloxy group, a carboxyl group, an alkoxycarbonyl group, an alkoxycarbonylamino group, an aryl group, a sulfo group (including its salt form), a cyano group, an alkyl group, a cabamoyl group or a sulfamoyl group or any two adjacent members thereof may be linked together to form a ring, e.g., a benzene ring, a combination of $R_1$ and $R_2$, $R_2$ and $R_3$, $R_3$ and $R_4$ or $R_4$ and $R_5$ being preferable.

In the above compound represented by formula (I), the alkoxy group, acylamino group, acyloxy group, alkyl group and carbamoyl group may preferably have 1 to 20 carbon atoms, and the alkoxycarbonyl group and alkoxycarbonylamino group may preferably have 2 to 20 carbon atoms.

Each of the above compounds (I) is a compound which is known to act as a reducing agent and forms an oxidation-reduction system under a certain equilibrium even in the emulsion; thus, such compound may be present in the silver halide emulsion in the oxidized and reduced forms. Therefore, an oxidized form of the compound (I) when added is also expected to exert a similar effect.

The phenol compound (I) may be preferably added during chemical ripening or after completion of chemical ripening. The amount of the phenol compound (I) to be added may vary depending upon properties of a particular silver halide, extent of chemical ripening (e.g., selenium-sensitization) given to the silver halide and the like, but a range of $10^{-7}$ mole to $10^{-1}$ mole per mole of silver is usually effective with $10^{-5}$ to $10^{-2}$ mole being particularly effective.

Representative examples of the phenol compound (I) which may be employed in this invention are given below, but this invention is not limited thereto.

[I - 1]

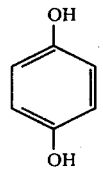

[I - 2]

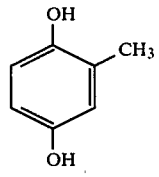

[I - 3]

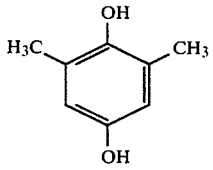

[I - 4]

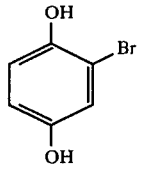

[I - 5]

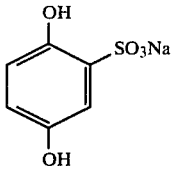

[I - 6]

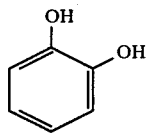

[I - 7]

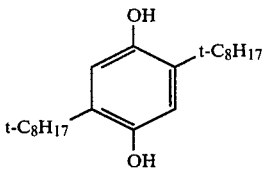

[I - 8]

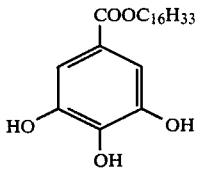

[I - 9]

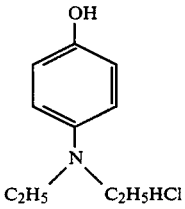

[I - 10]

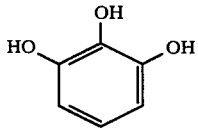

-continued

[I - 11]

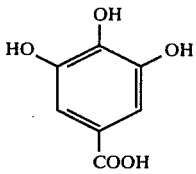

[I - 12]

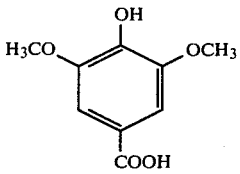

[I - 13]

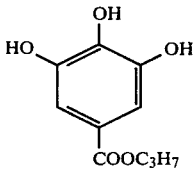

[I - 14]

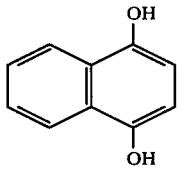

There is no particular limitation to optical sensitization of the present emulsion and optical sensitization, e.g., supersensitization may be effected by using, for example, optical sensitizers such as cyanine dye, e.g., zeromethine dye, monomethine dye, dimethine dye or trimethine dye or melocyanine dye alone or in combination therewith. Such sensitization techniques are also disclosed in U.S. Pat. Nos. 2,688,545, 2,912,329, 3,397,060, 3,615,635 and 3,628,946; British Pat. Nos. 1,195,302, 1,242,588 and 1,293,862; West German Patent Laid-Open Applications (OLS) Nos. 20 30 326 and 21 21 780; Japanese Patent Publications Nos. 4936/1968 and 14030/1969 and the like. Such techniques may be optionally selected and applied depending upon wavelength range to be sensitized, sensitivity, object and use of a photosensitive material.

The present emulsion may be further incorporated with a wide variety of additives commonly employed according to the desired purposes.

For instance, there may be incorporated antifoggants and stabilizers such as benzothiazolium salts, imidazolium salts, tetrazolium salts, nitroindazoles, nitrobenzimidazoles, chlorobenzimidazoles, bromobenzimidazoles, mercaptothiazoles, mercaptobenzimidazoles, triazoles, e.g., aminotriazoles, benztriazoles, nitrobenztriazoles, tetrazoles, e.g., mercaptotetrazoles (in particular, 1-phenyl-5-mercaptotetrazole), mercaptopyrimidines, mercaptotriazines, thioketo compounds (e.g., oxazolinethione), benzenethiosulfinic acid, benzene sulfinic acid, benzenesulfonamide, azaindenes, polyhydroxy compounds and the like; film hardening agents belonging to, for instance, aldehyde, azilidine, inoxazole, vinylsulfone, acryloyl, carbodiimide, maleimide, methanesulfonate, triazine series compounds; development accelerators such as benzyl alcohol, polyoxyethylene series compounds and the like; image stabilizers belonging to, for instance, curomane, coumarane, bisphenol, sulfite ester series compounds and the like; lubricants such as waxes, glycerides of a higher fatty acid, an ester of a higher fatty acid with a higher alcohol; and so on.

They may be preferably added during chemical ripening or before coating.

As the binder for the present emulsion, there may be employed a gelatin and other various hydrophilic colloids. The gelatin as used herein may include gelatin itself and gelatin derivatives. As the gelatin derivatives, there may be included, for example, a reaction product of gelatin with an acid anhydride, a reaction product of gelatin with an isocyanate or a reaction product of gelatin with a compound having an active halogen atom. The acid anhydride employable for reaction with gelatin may include, for example, maleic anhydride, phthalic anhydride, benzoic anhydride, acetic anhydride, isatoic anhydride, succinic anhydride and the like. The isocyanate may include, for example, phenyl isocyanate, p-bromophenyl isocyanate, p-chlorophenyl isocyanate, p-tolyl isocyanate, p-nitrophenyl isocyanate, naphthyl isocyanate, and the like. As the active halogen atom-containing compound, there may be mentioned, for example, benzenesulfonyl chloride, p-methoxybenzenesulfonyl chloride, p-phenoxybenzenesulfonyl chloride, p-bromobenzenesulfonyl chloride, p-toluenesulfonyl chloride, m-nitrobenzenesulfonyl chloride, m-sulfobenzoyl dichloride, naphthalene-β-sulfonyl chloride, p-chlorobenzenesulfonyl chloride, 3-nitro-4-aminobenzenesulfonyl chloride, 2-carboxy-4-bromobenzenesulfonyl chloride, m-carboxybenzenesulfonyl chloride, 2-amino-5-methylbenzensulfonyl chloride, phthalyl chloride, p-nitrobenzoyl chloride, benzoyl chloride, ethyl chlorocarbonate, furoyl chloride and the like.

As the hydrophilic colloid for the present emulsion, there may be employed, in addition to the above-mentioned gelatin derivatives and conventional photographic gelatin, colloidal alubmin, agar, gum arabic, dextran, arginic acid, cellulose derivatives such as hydrolyzed cellulose acetate having an acetyl content of 19–26%, polyacrylamide, imidated polyacrylamide, casein, a vinyl alcohol copolymer containing a urethanecarboxylic acid group or a cyanoacetyl group, e.g., a vinyl alcohol-vinyl cyanoacetate copolymer, polyvinyl alcohol-polyvinyl pyrrolidone, a hydrolyzed polyvinyl acetate, a polymer derived from polymerization of a protein or a saturated, acylated protein with a monomer having a vinyl group, polyvinyl pyridine, polyvinyl amine, polyaminoethyl methacrylate, polyethyleneimine and the like.

A wide variety of well-known surfactants may be also incorporated into the present emulsion for purposes of coating aid, antistatic, improved slip, emulsified dispersion, adhesion proof and improved photographic properties, e.g., development acceleration, high contrast, sensitization and so on. Such surfactants are disclosed in U.S. Pat. Nos. 2,240,472, 2,831,766, 3,158,484, 3,210,191, 3,294,540, 3,507,660; British Pat. Nos. 1,012,495, 1,022,878, 1,179,290, 1,198,450; U.S. Pat. Nos. 2,739,891, 2,823,123, 1,179,290, 1,198,450, 2,739,891, 2,823,123, 3,058,101, 3,415,649, 3,666,478, 3,756,828; British Pat. Nos. 1,397,218, 3,113,816, 3,411,413, 3,473,174, 3,345,974, 3,726,683, 3,843,368; Belgian Pat. No. 731,126; British Pat. Nos. 1,138,514, 1,159,825, 1,374,780; U.S. Pat. Nos. 2,271,623, 2,288,226, 2,944,900, 3,235,919, 3,671,247, 3,772,021, 3,589,906, 3,666,478, 3,754,924; West German Patent Laid-Open Application (OLS) No. 19 61 683; Japanese Patent Laid-Open Applications Nos. 117414/1975 and 59025/1975; Japanese Patent Publications Nos. 378/1965, 379/1965 and 13822/1968. There may be employed nonionic surfactants such as steroidal saponins; alkylene oxide derivatives, e.g., polyethylene glycol, polyethylene glycol/polypropylene glycol condensate, polyethylene glycol alkyl or alkylaryl ether, polyethylene glycol sorbitan esters, polyalkylene glycol alkylamines or amides, polyethylene oxide adducts of silicone; glycidol derivatives, e.g., alkenyl succinic acid polyglycerides, alkylphenol polyglycerides, polyhydric alcohol aliphatic acid esters, sugar alkyl esters, ethers or urethanes; anionic surfactants containing such acidic groups as a carboxyl, sulfo, phospho, sulfate or phosphate group such as triterpenoidal saponins; alkylcarboxylic acid salts; alkylbenzenesulfonates; alkylnaphthalenesulfonates; alkyl sulfates; alkyl phosphates; N-acyl-N-alkyltauric acids; sulfosuccinates; sulfoalkylpolyoxyethylene alkyl phenyl ethers; polyoxyethylene alkyl phosphates: Amphoteric surfactants such as amino acids; aminoalkylsulfonic acids; aminoalkylsulfuric or phosphoric acids; alkyl betaines; amine imides, amine oxides; or cationic surfactants such as alkyl amine salts; aliphatic or aromatic quaternary ammonium salts; heterocyclic quaternay ammonium salts, e.g., pyridium or imidazolium ammonium salts; aliphatic or heterocyclic sulfonium salts. The present emulsion may also include as a development accelerator any of imidazoles, thioethers or selenoethers as disclosed in West German Patent Laid-Open Application Nos. 20 02 871, 24 45 611 and 23 60 878 and British Pat. No. 1,352,196, besides the above-recited surfactants.

In applying the present emulsion to a color photosensitive material, one may suitably employ any procedures and materials commonly used for a color photosensitive material, typically incorporation of yellow, magenta and/or cyan couplers alone or in combination therewith into the present emulsion and nondiffusible couplers having a hydrophobic group or the so-called ballast group are preferable. A coupler may be either 4 equivalent or 2 equivalent to a silver ion. Moreover, there may be incorporated a colored coupler having a color correction effect or a coupler capable of releasing a development inhibitor as developments proceeds or the so-called DIR coupler. A coupler may be also the one capable of forming a colorless product upon coupling reaction.

As the yellow coupler, there may be employed any well-known open-chain ketomethylene-type couplers and, among them, benzoylacetanilide and pivaloylacetanilide compounds are advantageously employable. Illustrative examples of yellow color couplers which may be used are those as disclosed in U.S. Pat. Nos. 2,875,057, 3,265,506, 3,408,194, 3,551,155, 3,582,322, 3,725,072 and 3,891,445, West German Pat. No. 15 47 868, West German Patent Laid-Open Applications (OLS) Nos. 22 13 461, 22 19 917, 22 61 361, 24 14 006 and 22 63 875 and so on.

As the magenta coupler, there may be employed any of pyrazolone, indazolone, cyanoacetyl compounds and the like. Pyrazolone compounds are particularly advantageous. Illustrative examples of magenta couplers which may be employed are those as disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No 18 10 464, West German Patent Laid-Open Application (OLS) Nos. 24 08 665, 24 17 945, 24 18 959, 24 24 467, Japanese Patent Publication No. 6031/1965 and so on.

As the cyan coupler, there may be employed any of phenol compounds, naphthol compounds and the like. Illustrative examples thereof are those as disclosed in U.S. Pat. Nos. 2,369,929, 2,434,272, 2,474,293, 2,521,908, 2,895,826, 3,034,892, 3,311,476, 3,458,315, 3,476,563, 3,583,971, 3,519,383, 3,767,411, West German Patent Laid-Open Applications (OLS) Nos. 24 14 830 and 24 54 329, Japanese Patent Laid-Open Application No. 59838/1973 and so on.

As the colored coupler, there may be employed those as disclosed, for example, in U.S. Pat. Nos. 3,476,560, 2,521,908, 3,034,892, Japanese Patent Publication Nos. 2016/1969, 22335/1963, 11304/1967, 32461/1969, West German Patent Laid-Open Application (OLS) No. 24 18 959.

As the DIR coupler, there may be employed those as disclosed, for example, in U.S. Pat. Nos. 3,227,554, 3,617,291, 3,701,783, 3,790,384, 3,632,345, West German Patent Laid-Open Application (OLS) Nos. 24 14 006, 24 54 301, 24 54 329, British Pat. No. 953,454, Japanese Patent Application No. 146570/1975.

Besides the said DIR coupler, a photosensitive material may also include a compound which may release a development inhibitors or restrainer as development proceeds, for example, those as disclosed in U.S. Pat. Nos. 3,297,445 and 3,379,529, West German Laid-Open Application (OLS) No. 24 17 914. Further, there may be also employed those couplers as disclosed in Japanese Patent Laid-Open Application Nos. 85549/1980, 94752/1982, 65134/1981, 135841/1981, 130716/1979, 133734/1981, 135841/1979, U.S. Pat. No. 4,310,618, British Pat. No. 2,083,640, Research Disclosure No. 18360 (1979), No. 14850 (1980), No. 19033 (1980), No. 19146 (1980), No. 20525 (1981) and No. 21728 (1982).

Two or more of the said couplers may be incorporated into a single layer or a single compound may be contained in two or more layers.

Incorporation of the coupler into the emulsion layer may be effected according to any well-known methods, e.g., the method as described in U.S. Pat. No. 2,322,027. For instance, the coupler may be dissolved in an alkyl phthalate (e.g., dibutyl phthalate, dioctyl phthalate and the like), a phosphate (e.g., diphenyl phosphate, triphenyl phosphate, tricresyl phosphate, dioctyl butyl phosphate), a citrate (e.g., tributyl acetylcitrate), a benzoate (e.g., octyl benzoate), an alkylamide (e.g., diethyl lauryl amide) or an organic solvent having a boiling point of about 30° C. to 150° C. (e.g., a lower alkyl acetate such as ethyl acetate or butyl acetate, ethyl propionate, sec.-butyl alcohol, methyl isobutyl ketone, $\beta$-ethoxyethyl acetate, methyl cellosolve acetate and the like) and then dispersed in a hydrophilic colloid, a mixture of the said high-boiling organic solvent with the said low-boiling organic solvent being optionally employed.

A coupler having such an acidic group as carboxylic acid or sulfonic acid may be incorporated into a hydrophilic colloid in the form of an alkaline solution thereof.

The coupler may be generally added at $2\times10^{-3}$ to $5\times10^{-1}$ mole, preferably $1\times10^{-2}$ mole to $5\times10^{-1}$ mole, per mole of silver in an emulsion layer.

As the antistatic agent which may be employed in this invention, there may be effectively used cellulose diacetate, a styrene perfluoroalkylidium maleate copolymer, an alkali salt of a reaction product of a styrene-maleic anhydride copolymer with p-aminobenzenesulfonic acid and the like.

As the matting agent, there may be mentioned, for example, poly(methyl methacrylate), polystyrene, an alkali-soluble polymer and the like, and a colloidal silicon oxide is also employable.

As the latex for improving film properties, there may be mentioned, for example, a copolymer of an acrylic acid ester or vinyl ester with other ethylenic monomer. As the plasticizer for gelatin, there may be mentioned, for example, glycerol, a glycol compound and the like.

As the thickening agent, there may be mentioned, for example, a styrene-sodium maleate copolymer, an alkyl vinyl ether-maleic acid copolymer and the like.

As the base or support for the photosensitive material prepared from the present emulsion, there may be mentioned, for example, a baryta paper, a polyethylene-coated paper, a polypropylene synthetic paper, a glass paper, cellulose acetate, cellulose nitrate, polyvinyl acetal, polypropylene, a polyester film, (e.g., polyethylene terephthalate film), polystyrene and the like. Any of these bases may be optionally selected in accordance with the purposes of using the photosensitive material. Where necessary, the base may be subjected to undercoating, antistatic processing and the like.

The photosensitive material prepared from the present emulsion may be developed after exposure by using any conventional methods.

A black and white developing solution is an alkali solution containing a developing agent such as a hydroxybenzene, an aminophenol, an aminobenzene and the like and optionally further a sulfite, a carbonate, a bisulfite, a bromide and/or an iodide and the like. In case of a color photosensitive material, color development may be carried out according to a conventional color developing method. In reversal development, development is done with a black negative developing solution and then exposure to white light is given or processing may be effected in a bath containing a fogging agent and color development effected with an alkali developing solution containing a color developing agent.

Processing methods are not critical and any of them may be applicable. For instance, a method where color development and bleaching and fixing are conducted and, if necessary, washing and stabilization are done or a method wherein color development is effected and then bleaching and fixing are separately done and subsequently, if desired, washing and stabilization are done may be typically applicable.

Further, it is also known to the art that a photosensitive material containing smaller amount of silver halide may be processed by an amplifying agent such as a cobalt complex of hydrogen peroxide. By using such processing methods, the photosensitive material according to this invention may also be treated. For the purpose of rapid processing, these processing methods may sometimes be conducted at an elevated temperature, while they may sometimes be carried out at room temperature or in special cases at a temperature lower than room temperature. When a rapid processing is to be made at elevated temperature, a pre-treatment for film-hardening can also be carried out. Further, various kinds of auxiliary baths such as a neutralizing bath may sometimes be needed depending upon the sort of treating agents to be employed, and these auxiliary baths may optionally be used as occasion demands.

The present emulsion may be suitably applied to various photosensitive materials in view of its remarkably high sensitivity with less fogging. For instance, the present photosensitive material may be employed for many purposes, e.g., common black and white, X-ray, color, infrared, micro, silver dye bleaching, reversal, deffusion transfer process and other purposes.

This invention will be more concretely explained by way of the following examples, but this invention is not intended to be limited thereto.

EXAMPLE 1

The following 4 types of cubic Emulsions A, B, C and D, each comprising silver iodobromide containing 7 molar % of silver iodide and having an average grain diameter of 1.0μ, were prepared. Namely, the Emulsion A contained a core/shell-type silver iodobromide having a silver bromide shell with a thickness of 0.3 μm; the Emulsion B contained a core/shell-type silver iodobromide having a silver bromide shell with a thickness of 0.05 μm; the Emulsion C contained a core/shell-type silver iodo bromide having a silver bromide shell with a thickness of 0.01 μm; and the Emulsion D contained silver iodobromide containing uniformly distributed silver iodide and no silver bromide shell.

Then, the said Emulsions A, B, C and D were selenium-sensitized at 60° C. by using N,N-dimethylselenourea (0.45 mg/AgX mole; hereinafter referred to as labile selenium sensitizer X) or sodium selenocyanate (0.45 mg/AgX mole; hereinafter referred to as non-labile selenium sensitizer Y) and ammonium thiocyanate (150 mg/AgX mole) and then a stabilizer, 4-hydroxy-6-methyl-1,3,3a,7-tetrazaindene, was added to each Emulsion.

Each Emulsion was divided into some portions and one of the compounds of the general formula (I) (250 mg/AgX mole) was added to a portion thereof as shown in the following Table 1. Then, proper amounts of formalin as a hardening agent and saponin as a coating aid were added and the resulting mixture was coated over a polyethylene terephthalate film to a silver amount of 50 mg/100 $cm^2$ and dried to form Samples No. 1 to No. 19. Each Sample was subjected to exposure with 3.2 CMS (Candela-Meter-Second), for 1/50 second by means of a KS-1 type sensitometer (manufactured by Konishiroku Photo Ind. Co., Ltd.), developed at 40° for 30 seconds by using a developing solution having the under-mentioned formulation and fixed, water-washed and dried in a conventional manner.

Formulation of Developing Solution

| | |
|---|---|
| Sodium sulfite | 70 g |
| Hydroquinone | 10 g |
| Boric anhydride | 1 g |
| Sodium carbonate monohydrate | 20 g |
| 1-Phenyl-3-pyrazolidone | 0.35 g |
| Sodium hydroxide | 3 g |
| 5-Methylbenzotriazole | 0.05 g |
| Potassium bromide | 5 g |
| Glutaraldehyde bisulfite | 15 g |
| Acetic acid | 5 g |
| Water to make up | 1 l |

The results are shown in the following Table 1, wherein sensitivity is shown in terms of a relative sensitivity as the sensitivity of the Sample No. 4 being defined 100 and gamma (γ) is shown in terms of an average gradient between 0.1 and 0.5 in photographic densities excluding fogging.

TABLE 1

| Sample No. | Emulsion | Selenium sensitizer | Illustrative compd. (I) | Relative sensitivity | Fogging | γ | Remark |
|---|---|---|---|---|---|---|---|
| 1 | A | X | — | 115 | 0.01 | 2.4 | This |
| 2 | B | X | — | 160 | 0.01 | 2.5 | invention |
| 3 | C | X | — | 110 | 0.02 | 2.3 | |
| 4 | D | X | — | 100 | 0.03 | 2.1 | (Standard) |
| 5 | A | Y | — | 97 | 0.01 | 2.1 | Out of this |
| 6 | B | Y | — | 103 | 0.01 | 2.2 | invention |
| 7 | C | Y | — | 85 | 0.01 | 1.9 | |
| 8 | D | Y | — | 75 | 0.02 | 1.7 | |
| 9 | A | X | I - 1 | 140 | 0.01 | 2.6 | This |
| 10 | B | X | I - 1 | 182 | 0.01 | 3.0 | invention |
| 11 | B | X | I - 6 | 178 | 0.01 | 2.9 | |
| 12 | B | X | I - 7 | 165 | 0.01 | 2.7 | |
| 13 | B | X | I - 12 | 165 | 0.01 | 2.8 | |
| 14 | C | X | I - 1 | 115 | 0.02 | 2.4 | |
| 15 | D | X | I - 1 | 110 | 0.04 | 2.2 | Out of this |
| 16 | A | Y | I - 1 | 101 | 0.01 | 2.2 | invention |
| 17 | B | Y | I - 1 | 115 | 0.01 | 2.2 | |
| 18 | C | Y | I - 1 | 90 | 0.01 | 2.0 | |
| 19 | D | Y | I - 1 | 80 | 0.01 | 1.9 | |

As apparent from the above results, the present Sample Nos. 1 to 3 and Nos. 9 to 14 are shown to have higher sensitivity and higher γ, as compared with other Samples. Moreover, the results in the Table 1 teach that characteristics may vary depending upon the thickness of shell and there may be the most adequate thickness of shell.

EXAMPLE 2

The following 4 types of octahedron Emulsions E, F, G and H, each comprising silver iodobromide containing 4 molar % of silver iodide and having an average grain diameter of 1.6μ, were prepared. Namely, the Emulsion E contained a core/shell-type silver iodobromide having a silver bromide shell with a thickness of 0.3μ; the Emulsion F contained a core/shell-type silver iodobromide having a silver bromide shell with a thickness of 0.05 μm; the Emulsion G contained a core/shell-type silver iodobromide having a silver bromide shell with a thickness of 0.01 μm; and the Emulsion H contained a core/shell-type silver iodobromide containing uniformly distributed silver iodide and no silver bromide shell.

Then, in the same manner as in Example 1 above, the said Emulsions E, F, G and H were selenium-sensitized at 60° C. by using N,N-dimethylselenourea (X) or sodium seleno-cyanate (Y) (0.15 mg/AgX mole) and then a stabilizer, 4-hydroxy-6-methyl-1,3,3a,7-tetrazaindene and 1-phenyl-5-mercaptotetrazole were added to each Emulsion.

Each Emulsion was divided into some portions and one of the compounds of the general formula (I) (250 mg/AgX mole) was added to a portion thereof as shown in the following Table 2. Further, a protect-dispersed dispersion of a yellow coupler, α-[4-(1-benzyl-2-phenyl- 3,5-dioxo-1,2,4-triazolidinyl)-[α-pivalyl-2-chloro-5-γ-(2, 4-di-tert-amylphenoxy)-butyramido]acetanilide, a hardening agent, 1,3,5-triacryloylhexahydro-s-triazine and 1,2-bis(vinylsulfonyl)ethane and a coating aid, saponin, were added thereto.

The Emulsion thus prepared was coated over a cellulose triacetate film base.

Then, each Sample was subjected to white wedge exposure (1/50 second) and then to color negative development as described below.

| Processing step | Processing time |
|---|---|
| Color development | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilization | 1 min. 30 sec. |

Processing solutions employed in the above processing steps had the following formulations.

| | |
|---|---|
| Color developing solution | |
| 4-Amono-3-methyl-N—ethyl-N—(β-hydroxyethyl)-aniline sulfate | 4.8 g |
| Anhydrous potassium | 0.14 g |
| Hydroxylamine ½ sulfate | 1.98 g |
| Sulfuric acid | 0.74 g |
| Anhydrous potassium carbonate | 28.85 g |
| Anhydrous potassium hydrogencarbonate | 3.46 g |
| Anhydrous potassium sulfite | 5.10 g |
| Potassium bromide | 1.16 g |
| Sodium chloride | 0.14 g |
| Trisodium nitrilotriacetate monohydrate | 1.20 g |
| Potassium hydroxide | 1.48 g |
| Water to make up | 1 l |
| Bleaching solution | |
| Iron ammonium ethylenediamine-tetraacetate | 100.0 g |
| Diammonium ethylenediamine-tetraacetate | 10.0 g |
| Ammonium bromide | 150.0 g |
| Glacial acetic acid | 10.0 ml |
| Water to make up | 1 l |
| Adjusted to pH 6.0 | |
| Fixing solution | |
| Ammonium thiosulfate | 175.0 g |
| Anhydrous sodium sulfite | 8.6 g |
| Sodium metasulfite | 2.3 g |
| Water to make up | 1 l |
| Adjusted to pH 6.0 | |
| Stabilization solution | |
| Formalin (37%) | 1.5 ml |
| "Konidax" (manufactured by Konishiroku Photo Ind. Co., Ltd.) | 7.5 ml |
| Water to make up | 1 l |

Each Sample as processed above was subjected to sensitometry according to a conventional method. The results are summarized in the following Table 2, wherein sensitivity and gamma (γ) are given in the same manner as in Example 1 except that sensitivity of Sample No. 23 is defined 100.

TABLE 2

| Sample No. | Emulsion | Selenium sensitizer | Illustrative compd. (I) | Relative sensitivity | Fogging | γ | Remark |
|---|---|---|---|---|---|---|---|
| 20 | E | X | — | 126 | 0.02 | 0.52 | This |
| 21 | F | X | — | 170 | 0.03 | 0.55 | invention |
| 22 | G | X | — | 112 | 0.03 | 0.50 | |
| 23 | H | X | — | 100 | 0.04 | 0.39 | (Standard) |
| 24 | E | Y | — | 107 | 0.02 | 0.45 | Out of this |
| 25 | F | Y | — | 110 | 0.02 | 0.47 | invention |
| 26 | G | Y | — | 85 | 0.03 | 0.41 | |
| 27 | H | Y | — | 83 | 0.03 | 0.35 | |
| 28 | E | X | I - 1 | 155 | 0.02 | 0.63 | This |
| 29 | F | X | I - 1 | 200 | 0.03 | 0.70 | invention |
| 30 | F | X | I - 6 | 195 | 0.03 | 0.67 | |
| 31 | F | X | I - 7 | 182 | 0.03 | 0.65 | |
| 32 | F | X | I - 12 | 180 | 0.02 | 0.60 | |
| 33 | G | X | I - 1 | 125 | 0.04 | 0.55 | |
| 34 | H | X | I - 1 | 119 | 0.05 | 0.45 | Out of this |

TABLE 2-continued

| Sample No. | Emulsion | Selenium sensitizer | Illustrative compd. (I) | Relative sensitivity | Fogging | γ | Remark |
|---|---|---|---|---|---|---|---|
| 35 | E | Y | I - 1 | 110 | 0.02 | 0.46 | invention |
| 36 | F | Y | I - 1 | 128 | 0.02 | 0.48 | |
| 37 | G | Y | I - 1 | 93 | 0.04 | 0.43 | |
| 38 | H | Y | I - 1 | 82 | 0.04 | 0.38 | |

As apparent from the above results, it has been proved that the present Sample Nos. 20 to 22 and Nos. 28 to 33 show higher sensitivity and a higher γ value as compared with other Samples.

EXAMPLE 3

The Emulsions B and F as prepared in Examples 1 and 2, respectively, were subjected to selenium-sensitization by using N,N-dimethylselenourea (X) in the presence or absence of ammonium thiocyanate for a silver halide emulsion. To each Emulsion were then added the same sorts of stabilizer, coupled dispersion, hardening agent and coating agent as done in Example 2 and the resulting Emulsion was coated over a triacetate film base support and dried. The samples were subjected to sensitometry in the same manner as in Example 2. The results are summarized in the following Table 3.

TABLE 3

| Sample No. | Emulsion | Selenium sensitizer X (mg/mole AgX) | Ammonium thiocyanate (mg/mole AgX) | Temp. (°C.) | Fogging | Sensitivity |
|---|---|---|---|---|---|---|
| 39 | B | 0.45 | 0 | 60° | 0.01 | 100 (Standard) |
| 40 | B | 0.45 | 90 | 60 | 0.02 | 157 |
| 41 | F | 0.15 | 0 | 60 | 0.01 | 100 (Standard) |
| 42 | F | 0.15 | 90 | 60 | 0.01 | 129 |

As apparent from the above results, it has been proved that sensitizing effect can be remarkably improved in those samples wherein the present silver halide grains were chemically sensitized in the presence of ammonium thiocyanate as a silver halide solvent.

EXAMPLE 4

The following 4 types of octahedron Emulsions I, J, K and L, each comprising silver iodobromide containing 2.5 molar % of silver iodide and having an average grain diameter of 0.8 μ, were prepared. Namely, the Emulsion I contained no silver bromide shell with a distribution of 33%; the Emulsion J contained no silver bromide shell with a distribution of 18%; the Emulsion K contained a silver bromide shell with a thickness of 0.1μ and with a distribution of 31%; and the Emulsion L contained a silver bromide shell with a thickness of 0.1μ and with a distribution of 19%.

Then, to the thus prepared Emulsions were added, as shown in the following Table 4, N,N-dimethylselenourea (a labile selenium compound, X, 0.6 mg/AgX mole), sodium selenocyanide (a non-labile compound, Y, 0.6 mg/AgX mole) or sodium thiosulfate (a sulphur sensitizer, referred to hereinafter as S, 4.0 mg/AgX mole) and chemical ripening was effected at 50° C. over 45 minutes. Where a gold sensitizer (referred to hereinafter as Au) and a silver halide solvent (referred to hereinafter as Z) were also used, potassium chloroaurate (0.5 mg/AgX mole) and potassium thiocyanate (700 mg) were applied. Thereafter, a stabilizer, 4-hydroxy-6-methyl-1,3,3a,7-tetrazaindene, was added and a spreader and a hardening agent were then added. The resulting Emulsion was coated over an subbed polyethylene terephthalate film base up to a silver amount of 50 mg/100 $cm^2$ and dried to prepare Samples Nos. 43 to 52. Each Sample was exposed to 3.2 CMS for 1/50 second by using a KS-1 sensitometer and developed with a developing solution having the following formulation at 40° C. for 30 seconds followed by fixing, washing and drying in a conventional manner.

Developing solution

The same formulation as in Example 1.

The results are summarized in the following Table 4, wherein sensitivity is expressed in terms of a relative sensitivity as sensitivity of the Sample No. 43 being defined 100 and $\gamma$ is expressed similarly to Example 1.

TABLE 4

| Sample No. | Emulsion | Sensitizer | Relative sensitivity | Fogging | $\gamma$ | Remark |
|---|---|---|---|---|---|---|
| 43 | I | S | 100 | 0.02 | 2.20 | Comparative |
| 44 | I | Y | 110 | 0.03 | 2.10 | control |
| 45 | I | X | 130 | 0.07 | 1.65 | |
| 46 | I | X + Au + Z | 340 | 0.11 | 1.75 | |
| 47 | J | X | 135 | 0.05 | 1.90 | |
| 48 | K | X | 150 | 0.03 | 2.10 | |
| 49 | L | S | 110 | 0.02 | 2.25 | |
| 50 | L | Y | 120 | 0.02 | 2.25 | |
| 51 | L | X | 180 | 0.02 | 2.20 | This |
| 52 | L | X + Au + Z | 700 | 0.04 | 2.30 | invention |

As apparent from the above results, greater sensitization with lower fogging can be first accomplished without any soft gradation by chemical ripening of the present core/shell-type monodispersed emulsion in the presence of a labile selenium compound. Further, greater sensitizing effect with less increase in fogging can be accomplished in the monodisperse core/shell-type Emulsion L, as compared with a polydisperse non-core/shell-type emulsion I when used together with a gold sensitizer.

EXAMPLE 5

The following 4 types of octahedron Emulsions M, N, O and P, each comprising silver iodobromide containing 8 molar % of silver iodide and having an average grain diameter of 1.4 $\mu$, were prepared. Namely, the Emulsion M contained no silver bromide shell with a distribution of 26%; the Emulsion N contained no silver bromide shell with a distribution of 9%; the Emulsion O contained a silver bromide shell with a thickness of 0.05$\mu$ and with a distribution of 23%; and the Emulsion P contained a silver bromide shell with a thickness of 0.05$\mu$ and with a distribution of 11%.

Then, to the above emulsions were added, as shown in the following Table 5, N,N-dimethylselenourea (X, 0.2 mg/AgX mole), sodium selenocyanide (Y, 0.2 mg/AgX mole) or sodium thiosulfate (S, 1.8 mg/AgX mole) and chemical ripening was effected at 50° C. over 45 minutes. Where a gold sensitizer (Au) and a silver halide solvent (Z) were also used, potassium chloroaurate (0.25 mg/AgX mole) and potassium thiocyanate (400 mg) were applied. Thereafter, a stabilizer, 4-hydroxy-6-methyl-1,3,3a,7-tetrazindene, was added and then a protect-dispersed dispersion of an yellow coupler, $\alpha$-[4-(1-benzyl-2-phenyl-3,5-dioxo-1,2,4-triazolidinyl)]-$\alpha$-pivalyl-2-chloro-5-[$\gamma$-(2,4-di-t-amylphenoxy)butyramide] acetanilide, a spreader and a hardening agent were added and the resulting emulsion was coated over an subbed cellulose triacetate film base up to a silver amount of 15 mg/100 $cm^2$ and dried to prepare Sample Nos. 63 to 73.

Then, each Sample was subjected to white wedge exposure and then to color negative development in the same manner as in the above Example 2 using the same processing steps, color developing solution, bleaching solution, fixing solution and stabilization solution as in the above Example 2.

The results are summarized in the following Table 5, wherein sensitivity and gamma ($\gamma$) are given in the same manner as in Example 1 except that sensitivity of Sample No. 63 is defined 100.

TABLE 5

| Sample No. | Emulsion | Sensitizer | Relative sensitivity | Fogging | $\gamma$ | Remark |
|---|---|---|---|---|---|---|
| 63 | M | S | 100 | 0.03 | 0.80 | Comparative |
| 64 | M | Y | 107 | 0.04 | 0.73 | control |
| 65 | M | X | 124 | 0.09 | 0.48 | |
| 66 | M | X + Au + Z | 300 | 0.15 | 0.53 | |
| 67 | N | X | 130 | 0.07 | 0.66 | |
| 68 | O | X | 142 | 0.04 | 0.72 | |
| 69 | P | S | 110 | 0.03 | 0.85 | |
| 70 | P | Y | 118 | 0.03 | 0.84 | |
| 71 | P | X | 165 | 0.03 | 0.81 | This |
| 72 | P | X + Au + Z | 620 | 0.05 | 0.87 | invention |
| 73 | P | X + Au | 480 | 0.05 | 0.85 | |

As apparent from the above results, greater sensitization with lower fogging can be first accomplished without any soft gradation by chemical ripening of the present core/shell-type monodispersed emulsion in the presence of a labile selenium compound. Further, greater sensitizing effect with less increase in fogging can be accomplished in a monodisperse core/shell-type Emulsion P, as compared with a polydisperse non-core/shell-type Emulsion M when used together with a gold sensitizer.

EXAMPLE 6

According to the double jet method, there were prepared a polydispersed octahedral silver iodobromide emulsion containing 7 mole % of silver iodide having an average grain size of 1.60 $\mu$ (grain size distribution S/r=0.35) (hereinafter referred to as "Emulsion A"); a poly-dispersed octahedral silver iodobromide emulsion containing 7 mole % of silver iodide having an average grain size of 1.60$\mu$ (grain size distribution S/r=0.35), of which the shell consists only of silver bromide and the thickness of the shell being 0.16$\mu$ (hereinafter referred to as "Emulsion B"); and an emulsion having the same composition as in the above Emulsion B, the thickness of the shell consisting only of silver bromide being 0.08$\mu$ (hereinafter referred to as "Emulsion C"), respectively.

To each of the thus prepared silver iodobromide gelatin emulsions, one of various sensitizers was added in an amount as indicated below in Table 6 per one mole of the silver halide, and the mixture was subjected to chemical ripening at 55° C. for 50 minutes. After completion of the chemical ripening, a dispersion containing a magenta coupler represented by the following structural formula, was added thereto, and further a film-hardener was added thereto to prepare an emulsion. The thus prepared emulsion was coated on a support of a cellulose acetate film and dried.

(Magenta Coupler)

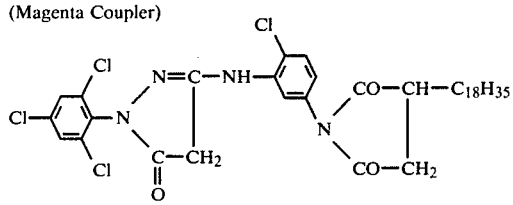

Each of the thus obtained sample was subjected to wedge exposure for 1/50 second through a green filter (available from Tokyo Shibaura Denki Kabushiki Kaisha) by using a KS-1 type sensitometer (manufactured by Konishiroku Photo Ind. Co., Ltd.), followed by development treatment according to the following processing procedure.

| Processing step (38° C.) | Processing time |
|---|---|
| Color development | 2 min. 45 sec. |
| Bleaching | 6 min. 30 sec. |
| Water washing | 3 min. 15 sec. |
| Fixing | 6 min. 30 sec. |
| Washing | 3 min. 15 sec. |
| Stabilization | 1 min. 30 sec. |

Compositions of the processing solution used in each processing step are as follows.

| | |
|---|---|
| Composition of the color developing solution: | |
| 4-Amino-3-methyl-N—ethyl-N—(β-hydroxyethyl)-aniline sulfate | 4.8 g |
| Anhydrous sodium sulfite | 0.14 g |
| Hydroxylamine · ½ sulfate | 1.98 g |
| Sulfuric acid | 0.74 mg |
| Anhydrous potassium carbonate | 28.85 g |
| Anhydrous potassium hydrogen carbonate | 3.46 g |
| Anhydrous potassium sulfite | 5.10 g |
| Potassium bromide | 1.16 g |
| Sodium chloride | 0.14 g |
| Nitrilotriacetic acid trisodium salt (monohydrate) | 1.20 g |
| Potassium hydroxide | 1.48 g |
| Made up to | 1 l |
| Composition of the bleaching solution: | |
| Ethylenediaminetetraacetic acid iron ammonium salt | 100.0 g |
| Ethylenediaminetetraacetic acid diammonium salt | 10.0 g |
| Ammonium bromide | 150.0 g |
| glacial acetic acid | 10.0 ml |
| Made up to 1 l followed by adjustment of pH to 6.0 by using aqueous ammonia. | |
| Composition of the fixing solution: | |
| Ammonium thiosulfate | 175.0 g |
| Anhydrous sodium sulfite | 8.6 g |
| Sodium metasulfite | 2.3 g |
| Made up to 1 l followed by adjustment of pH to 6.0 by using acetic acid | |
| Composition of the stabilizing solution: | |
| Formalin (37% aqueous solution) | 1.5 ml |
| Konidax (available from Konishiroku Photo Ind. Co., Ltd.) | 7.5 ml |
| Made up to | 1 l |

With respect to each sample having a magenta image obtained by the development treatment, sensitometry was conducted according to the JIS method, and sensitivity, fog and gamma (γ) were measured respectively. The results are shown in Table 6.

The sensitivity represents a reverse number of an exposure amount necessary for the photographic density (excluding fog) becoming 0.1, provided that the sensitivity of Sample No. 1 is standardized to be 100 and the other sensitivities are represented as a relative sensitivity thereto.

Gamma value was shown as an average gamma value of those at a point where the photographic density (excluding fog) is 0.1 and a point where it is 0.2.

TABLE 6

| | Sensitizer | | | Photographic properties | | | |
|---|---|---|---|---|---|---|---|
| Sample No. | sodium thiosulfate (mg) | N,N—dimethylselenourea (mg) | Shell thickness (μ) | Sensitivity | fog | Max. density | gamma |
| 1 | 1.0 | 0.2 | 0 | 100 | 0.28 | 2.97 | 0.50 |
| 2 | 1.0 | 0.2 | 0.08 | 133 | 0.25 | 3.31 | 0.58 |
| 3 | 1.0 | 0.2 | 0.16 | 138 | 0.25 | 3.34 | 0.57 |

As seen from the above Table 6, it can be understood that Emulsion Samples 2 and 3, which comprise core/shell type silver halide grains sensitized by the use of the sensitizers according to this invention, show high sensitivity and reduced fog, whereas Emulsion samples outside the scope of the invention have low sensitization effect and cause considerable fog.

Furthermore, it was found that the Samples according to this invention are excellent in the properties such as maximum density, gamma and so on when used together with a gold sensitizer.

We claim:

1. A silver halide photographic material having at least one silver halide emulsion layer on a support characterized in that an emulsion of said emulsion layer substantially contains core/shell silver halide grains, the core portion of said grain containing silver iodide in a greater amount than the shell portion of said grain, and said emulsion has been subjected to chemical ripening in the presence of a labile selenium compound sensitizer.

2. A silver halide photographic material according to claim 1 wherein said core/shell silver halide grains are core/shell monodisperse silver halide grains.

3. A silver halide photographic material according to claim 1 wherein said chemical ripening is effected in the presence of said labile selenium compound sensitizer and a silver halide solvent.

4. A silver halide photographic material according to claim 1 wherein said emulsion further contains at least one of phenol compounds having the formula

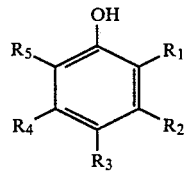

wherein $R_1$, $R_2$, $R_3$, $R_4$ and $R_5$ individually represent a hydrogen atom, a halogen atom, a hydroxy group, an alkoxy group, an amino group, an acylamino group, an acyloxy group, a carboxyl group, an alkoxycarbonyl group, an alkoxycarbonylamino group, an aryl group, a sulfo group, a cyano group, an alkyl group or a sulfamoyl group or wherein any two adjacent groups of said $R_5$ are linked together to form a ring.

5. A silver halide photographic material according to claim 1 wherein said core portion comprises a silver halide containing silver iodide at 1 to 15 molar % and said shell portion comprises a silver halide containing silver iodide at 0 to 5 molar %.

6. A silver halide photographic material according to claim 1 wherein said shell portion of grain has a thickness of 0.01 to 0.3 μm.

7. A silver halide photographic material according to claim 1 wherein said core/shell silver halide grain is of a octahedral or tetrahedral shape.

8. A silver halide photographic material according to claim 1 wherein all grains in the emulsion of said emulsion layer are of a core/shell.

9. A silver halide photographic material according to claim 1 wherein said labile selenium compound sensitizer is selected from a colloidal selenium metal, an aliphatic isoselenocyanate, an aliphatic selenourea, a selenoketone, a selenoamide and a selenocarboxylic acid.

10. A silver halide photographic material according to claim 1 wherein said labile selenium compound sensitizer is employed in an amount of $1.0\times10^{-4}$ to 5 mg per mole of a silver halide.

11. A silver halide photographic material according to claim 3 wherein said silver halide solvent is selected from an organic thioether, a thiourea derivative, an imidazole having a thiocarbonyl group between an oxygen or sulfur atom and a nitrogen atom, a sulfite and a thiocyanate.

12. A silver halide photographic material according to claim 3 wherein said silver halide solvent is selected from the following compounds;

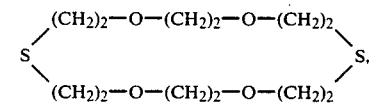

$HO-(CH_2)_2-S-(CH_2)_2-S-(CH_2)_2-OH$,

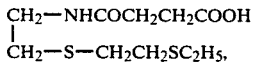

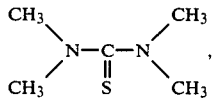

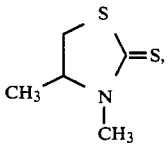

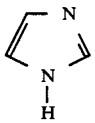

$K_2SO_3$,
$NH_4SCN$ and

-continued
KSCN.

13. A silver halide photographic material according to claim 4 wherein said phenol compound is added at $10^{-7}$ to $10^{-1}$ mole per mole of silver.

14. A silver halide photographic material according to claim 4 wherein said phenol compound is selected from the following compounds;

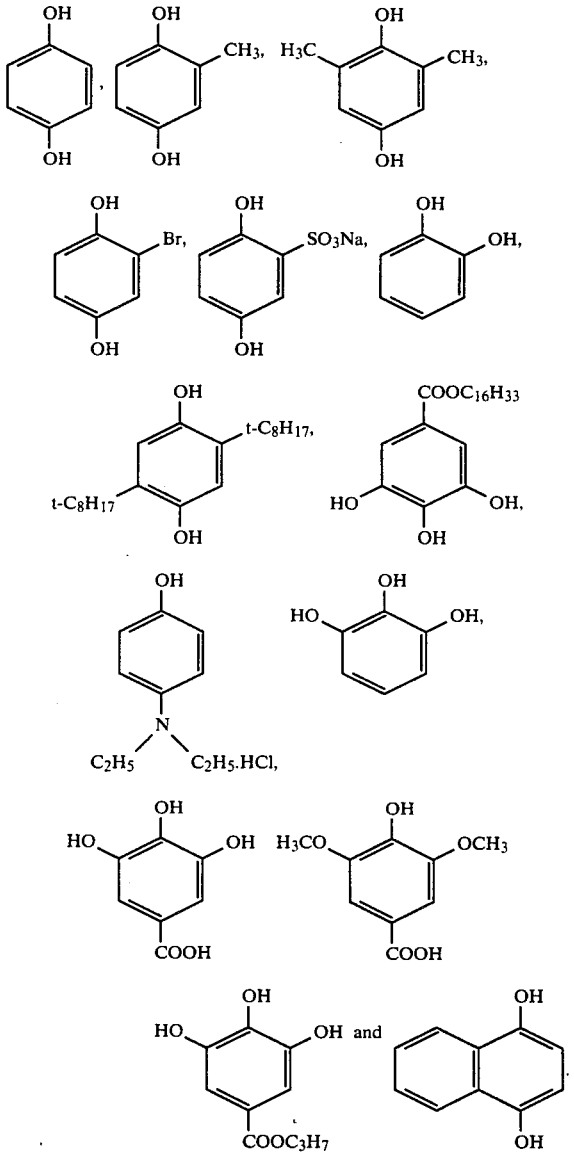

15. A silver halide photographic material according to claim 1 wherein said silver halide grains are core/shell silver iodobromide grains containing silver iodide and having a thickness of said shell portion of 0.01 to 0.3 μm and said labile selenium compound sensitizer is N,N-dimethylselenourea.

16. A silver halide photographic material according to claim 1, wherein said emulsion has further been subjected to sulfur sensitization.

17. A silver halide photographic material according to claim 1, wherein said emulsion according to claim 16 is a monodispersed emulsion.

18. A silver halide photographic material according to claim 16, said shell portion consists essentially of silver bromide.

19. A silver halide photographic material according to claim 16, said shell portion consists of 0 to 1 mole % of silver iodide and 99 to 100 mole % of silver bromide.

20. A silver halide photographic material according to claim 18, wherein said shell portion consists of 0 to 0.5 mole % of silver iodide and 99.5 to 100 mole % of silver bromide.

21. A silver halide photographic material according to claim 16, wherein said core portion comprises two or more layers.

22. A silver halide photographic material according to claim 18, wherein said core portion consists of a silver halide containing 2 to 15 mole % on average of silver iodide.

23. A silver halide photographic material according to claim 16, wherein the average content of silver iodide in said silver halide grains is 0.5 to 15 mole %.

24. A silver halide photographic material according to claim 23, wherein the average content of silver iodide in said silver halide grains is 5 to 12 mole %.

25. A silver halide photographic material according to claim 1, wherein said emulsion contains further a nitrogen-containing heterocyclic compound.

26. A silver halide photographic material according to claim 25, wherein said heterocyclic compound is 4-hydroxy-6-methyl-1,3,3a,7-tetrazaindene.

27. A silver halide photographic material according to claim 16, wherein said emulsion contains further a nitrogen-containing heterocyclic compound.

28. A silver halide photographic material according to claim 27, wherein said heterocyclic compound is 4-hydroxy-6-methyl-1,3,3a,7-tetrazaindene.

* * * * *